United States Patent [19]

Funaki

[11] 4,423,608

[45] Jan. 3, 1984

[54] WASHING APPARATUS

[75] Inventor: Kazuo Funaki, Kasugai, Japan

[73] Assignee: Tokyo Shibaura Denki Kabushiki Kaisha, Kanagawa, Japan

[21] Appl. No.: 448,323

[22] Filed: Dec. 9, 1982

[30] Foreign Application Priority Data

Dec. 30, 1981 [JP] Japan ..... 56-211684

[51] Int. Cl.[3] ..... D06F 37/24

[52] U.S. Cl. ..... 68/23.3; 68/3 R; 248/558; 248/610

[58] Field of Search ..... 68/3 R, 23 R, 23.3; 210/144, 364; 248/558, 610

[56] References Cited

U.S. PATENT DOCUMENTS 2,987,190 6/1961 Bochan ..... 210/364
3,922,890 12/1975 Shibata ..... 68/23 R
4,329,859 5/1982 Roberts ..... 68/23 R

FOREIGN PATENT DOCUMENTS 52-64162 5/1977 Japan .
53-1181 1/1978 Japan .

*Primary Examiner*—Philip R. Coe
*Assistant Examiner*—Thomas W. Epting
*Attorney, Agent, or Firm*—Cushman, Darby & Cushman

[57] ABSTRACT

A washing apparatus which comprises a casing in the form of a rectangular tube open at both ends, a water reservoir in the casing, a rotary tub in the water reservoir, an agitator in the rotary tub, driving device attached to the water reservoir and located inside the casing to selectively drive the rotary tub and agitator, suspending device elastically suspending the water reservoir and the driving device in the casing, and a pair of end members equal in size and shape and attached individually to both ends of the casing. Each end member has a rectangular ring-shaped frame attached to the peripheral edge portion at each corresponding end of the casing, and protrusions formed individually in the four corners of the frame. The protrusions of one end member constitute a support member supporting the suspending device, while the protrusions of the other end member constitute the legs of the casing.

17 Claims, 6 Drawing Figures

WASHING APPARATUS

BACKGROUND OF THE INVENTION

This invention relates to a washing apparatus.

A washing apparatus having dehydrating function generally comprises a water reservoir, a rotary tub, driving means, etc., which are suspended in a casing by elastic suspending means. The casing is a rectangular tube open at both ends which is formed by bending a steel plate and welding joint portions together. Supporting plates are welded to the four corners of the upper end opening of the casing, whereby four suspension rods of the elastic suspending means are supported individually. Base plates are welded to the four corners of the lower end opening, and legs of the casing are attached individually to the base plates. The supporting plates and base plates serve also as reinforcing plates for the casing.

Thus, the aforementioned prior art washing apparatus is provided with four supporting plates and four base plates. Such a substantial number or parts complicates parts control and assembly work. Moreover, reinforcement of the casing depends on the supporting plates and base plates only, so that the mechanical strength of the casing is low.

SUMMARY OF THE INVENTION

This invention is made in consideration of these circumstances, and is intended to provide washing apparatus having fewer parts in order to facilitate parts control, assembly, and which is improved in mechanical strength.

According to one aspect of the invention, there is provided a washing apparatus which comprises a casing in the form of a substantially rectangular tube open at both ends, a water reservoir in the casing, a rotary tub in the water reservoir, an agitator in the rotary tub, driving means attached to the water reservoir and located inside the casing to selectively drive the rotary tub and agitator, suspending means elastically suspending the water reservoir and the driving means in the casing, and a pair of end members equal in size and shape and attached individually to both ends of the casing. Each end member has a substantially rectangular ring-shaped frame attached to the peripheral edge portion at each corresponding end of the casing, and protrusions formed individually in the four corners of the frame. The protrusions of one end member constitute a support member supporting the suspending means, while the protrusions of the other end member constitute the legs of the casing.

Although having those different functions, the two end members are identical in size and shape. Accordingly, the end members can be handled as identical parts. Thus, according to the washing apparatus of the invention, the number of parts used can be greatly reduced to facilitate parts control, assembly. Moreover, the end members have their respective frames attached individually to the peripheral edge portions at both ends of the casing to serve as reinforcing members for the casing. Therefore, the mechanical strength of the washing apparatus of the invention is higher than that of the prior art washing apparatus.

BRIEF DESCRIPTION OF THE DRAWINGS

FIGS. 1 to 3 show a washing apparatus according to a first embodiment of this invention, in which FIG. 1 is a longitudinal sectional view of the washing apparatus, FIG. 2 is a disassembled perspective view of the washing apparatus, and FIG. 3 is an enlarged sectional view of the principal part of the washing apparatus;

FIGS. 5 and 6 show a washing apparatus according to a second embodiment of the invention, in which FIG. 5 is a longitudinal sectional view of the principal part of the washing apparatus, and FIG. 6 is a perspective view of an end member.

DETAILED DESCRIPTION OF THE PREFERRED EMBODIMENTS

There will now be described in detail several embodiment of this invention with reference to the accompanying drawings.

Figure 1:
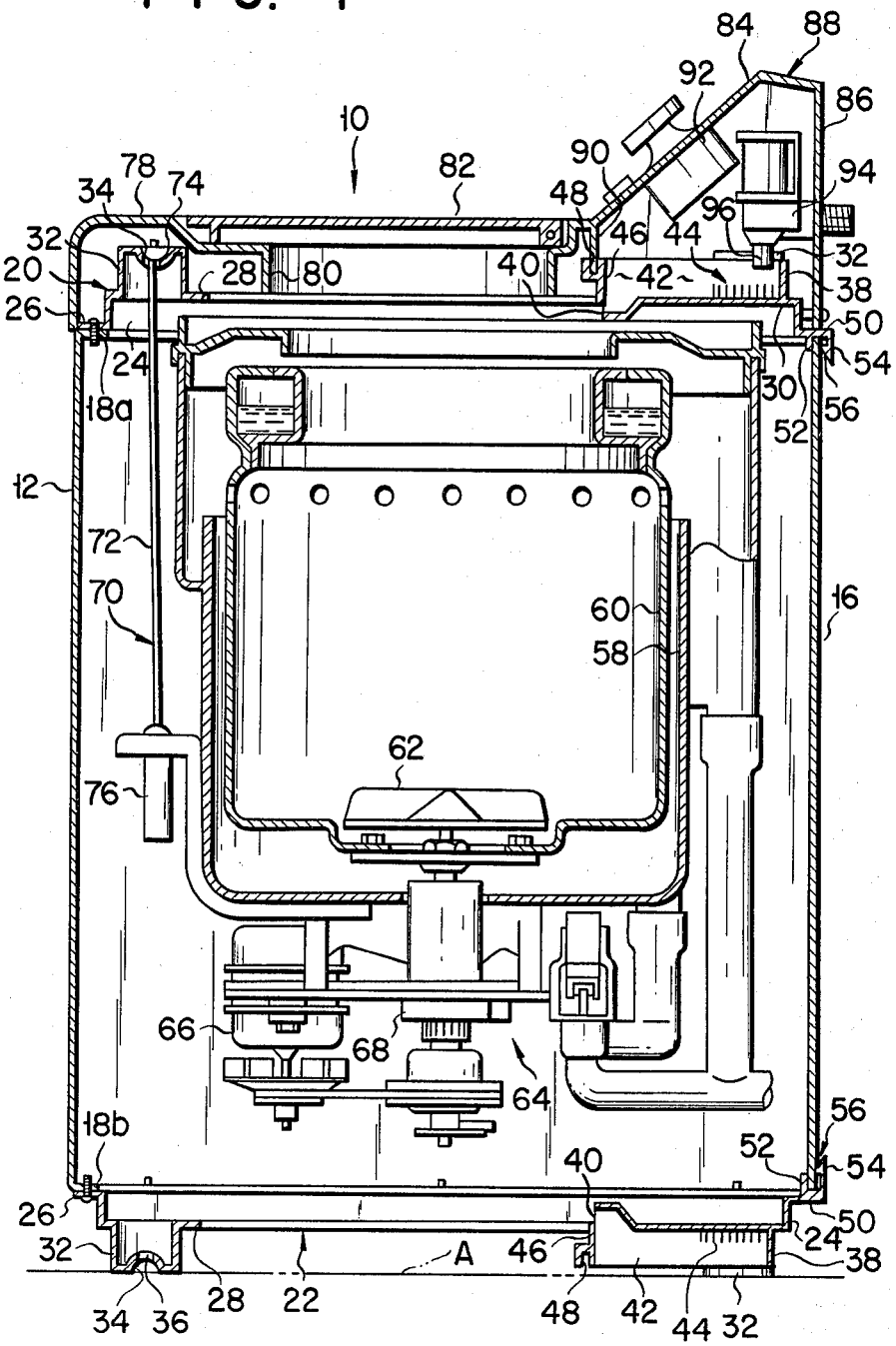
Figure 2:
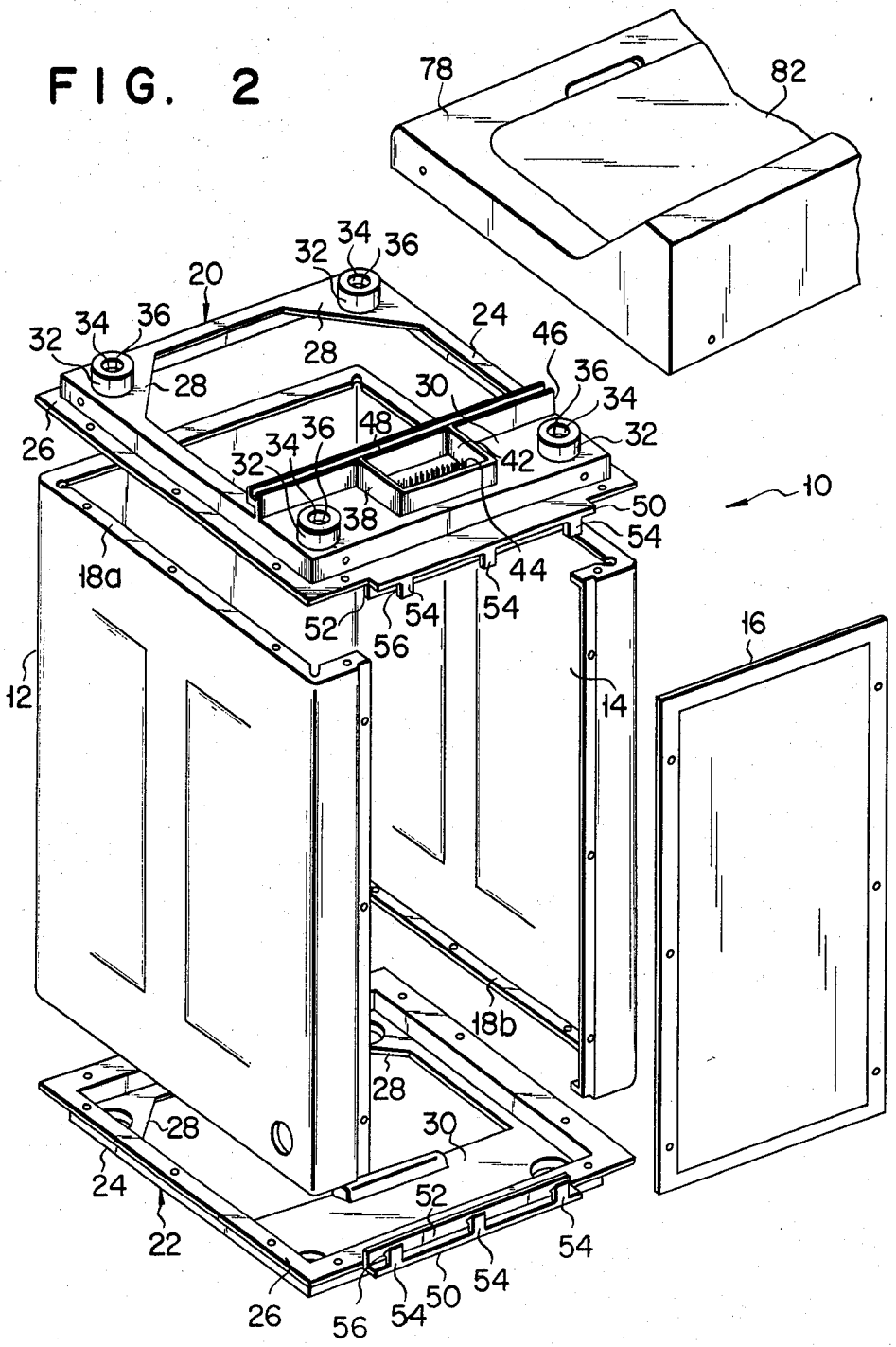

As shown in FIGS. 1 and 2, a washing apparatus 10 is provided with a casing 12. The casing 12 has the form of a substantially rectangular tube open at both ends, and is formed by bending a previously coated steel face plate. The casing 12 has an opening 14 for maintenance and inspection at the central portion of one lateral face or the back thereof. The opening 14 is blocked by a covering member 16. The casing 12 also has flange portions 18*a* and 18*b* extending inward from the peripheral edges at the upper and lower ends thereof, respectively.

The apparatus 10 is further provided with a pair of end members 20 and 22 attached to the upper and lower ends of the casing 12, respectively. Each of the end members 20 and 22 is formed of resin by using the same die, and are equal in size and shape. In the detailed description to follow, the end member 20 will be explained representatively. The end member 20 has a substantially rectangular ring-shaped frame 24. The frame 24 has a flange portion 26 formed along its peripheral edge and extending outward therefrom. Two reinforcing plates 28 are formed individually in two adjacent corners or front corners (FIG. 2) of the frame 24. A rectangular reinforcing plate 30 stretches over the remaining corners or both rear corners of the frame 24. Cylindrical protrusions 32 are formed individually on the two reinforcing plates 28 and both end portions of the third reinforcing plate 30, that is, in the four corners of the end member 20. Each protrusion 32 has a concave spherical seat 34 in its projected end face, and a penetrating hole 36 is bored through the spherical seat 34. A bank portion 38 in the form of an open-topped rectangular tube is formed on the upper surface of the reinforcing plate 30, lying between the two protrusions 32 thereon. An inlet port 40 is bored through the bottom of the bank portion 38 or the reinforcing plate 30. The bank portion 38 defines a flooding passage 42. Formed at the bottom of the bank portion 38, moreover, are a number of projections 44 for dampling water current and preventing splash. The end member 20 also has a projected wall 46 formed on the reinforcing plate 30. The projected wall 46 extends along the transverse direction of the end member 20, and has an engaging groove 48 formed along its projected end. Moreover, the end member 20 has an overhang portion 50 extending outward from one side edge or the rear edge (FIG. 2) of the flange portion 26. The overhang portion 50 is provided with a plate-like projected strip 52 extending along the transverse direction of the end member 20 and a plurality of projected strip 54 each having a retaining click facing the projected strip 52. An engaging groove 56 is defined between the projected strips 52 and 54. As described before, the end member 20 of this construction is integrally formed from resin.

The other end member 22 has the same construction as that of the aforementioned end member 20. In the description to follow, like reference numerals are used to designate the corresponding portions of the end members 20 and 22.

The end member 20 is attached to the upper end of the casing 12, having its flange portion 26 screwed to the flange portion 18*a* of the casing 12 so that the protrusions 32 protrude upward. The overhang portion 50 is located at the upper end of the opening 14 of the casing 12. The end member 22 is attached to the lower end of the casing 12, the reverse of the end member 20, that is, with its protrusions 32 protruding downward. The end member 22 is attached to the lower end of the casing 12, having its flange portion 26 screwed to the flange portion 18*b* of the casing 12. The overhang portion 50 of the end member 22 is located at the lower end of the opening 14 of the casing 12. As shown in FIG. 1, the casing 12 is set on a floor A with the aid of the protrusions 32 of the end member 22. Thus, the protrusions 32 of the end member 22 constitute legs in this invention.

Figure 3:
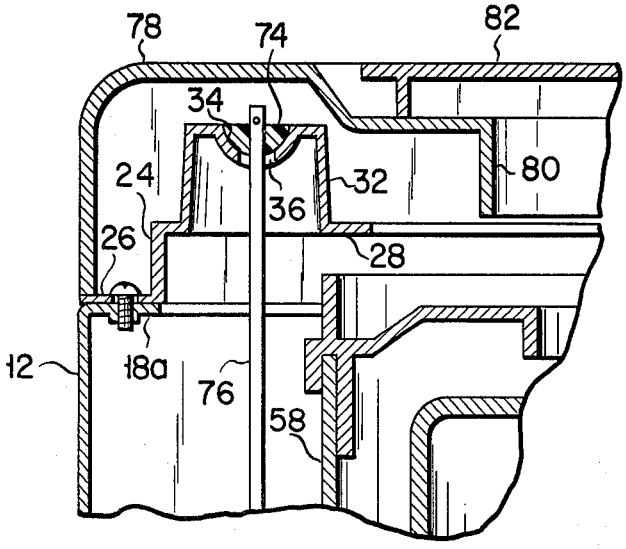

As seen from FIG. 1, the washing apparatus 10 comprises a water reservoir 58 in the casing 12 and a rotary tub 60 rotatable arranged in the water reservoir 58. A pulsator 62, serves as an agitator, is provided at the bottom portion of the rotary tub 60. Driving means 64 for selectively rotating the pulsator 62 and both the pulsator and the rotary tub 60 is attached to the outer bottom surface of the water reservoir 58. The driving means 64 includes a drive motor 66 and a transmission device 68 for selectively transmitting the driving force of the motor 66 to both the rotary tub 60 and pulsator 62 or the pulsator. The water reservoir 58 and the driving means 64 are elastically suspended in the casing 12 by suspending means 70. The suspending means 70 includes four suspension rods 72, sliders 74 attached individually to the upper end portions of the suspension rods 72, and vibration absorbing members 76 attached individually to the lower end portions of the suspension rods 72. As seen from FIG. 3, each slider 74 is formed from resin into a substantially hemispherical body, and is slidably fitted in the spherical seat 34 of its corresponding protrusion 32 of the end member 20. Each suspension rod 72 extends substantially vertically downward through the penetrating hole 36 of its corresponding protrusion 32. The lower end portion of each suspension rod 72 is elastically coupled to the bottom portion of the water reservoir 58 by means of the vibration absorbing member 76. Thus, the protrusions 32 of the end member 20 constitute supporting members to support the suspending means 70 in this invention.

Further, the apparatus 10 has a cover 72 screwed to the end member 20 to hang over the same. Formed at the substantially central portion of the cover 78 is an opening 80 through which washing is put into or taken out of the rotary tub 60. The opening 80 is covered by a lid 82 rockably attached to the cover 78. The cover 78 has a panel board 84 and a backboard 86, which, in conjunction with the reinforcing plate 30 of the end member 20, define an operation box 88 at the rear end portion of the cover 78. The cover 78 also has a projected wall 90 formed between the opening 80 and the operation box 88. The projected end portion of the projected wall 90 is fitted in the engaging groove 48 of the projected wall 46 of the end member 20. Thus, the interior of the operation box 88 is isolated from that of the rotary tub 60 by the projected walls 46 and 90. Arranged in the operation box 88 are a timer 92 for washing operation control, a solenoid valve 94 for feed water, etc. The solenoid valve 94 is attached to the backboard 86 so that a discharge port 96 of the solenoid valve 94 is located over the projections 44 of the flooding passage 42 of the end member 20. Water discharged from the discharge port 96 passes through the flooding passage 42, and flows down into the rotary tub 60 through the inlet port 40.

The covering member 16 covering the opening 14 of the casing 12 is screwed to the casing 12 after it is temporarily retained with its upper and lower end edges engages with the engaging grooves 56 of the end members 20 and 22, respectively.

The washing apparatus 10 of the aforementioned construction has the following advantages. Each of the end members 20 and 22 is formed by integrally forming the frame 24, the protrusions 32, and the reinforcing plates 28 and 30 from resin. Unlike the prior art washing apparatus which has separate supporting members and legs, therefore, the washing apparatus 10 of the invention requires only a small number of parts or components, including no members to be welded to the casing. Thus, parts control, assembly work, can be simplified. Despite the different functions, the two end members 20 and 22 are identical in size and shape. Accordingly, the end members 20 and 22 can be formed by using the same die, and can be handled as identical parts. Thus, the number of parts used can further be reduced. Moreover, the number of molding dies used, and hence, the manufacturing cost can be reduced. The end members have their respective substantially rectangular ring-shaped frames 24 attached to the upper and lower ends of the casing 12, respectively. Thus, the whole peripheral edges of the upper and lower ends of the casing 12 can be reinforced, so that the mechanical strength of the casing 12 can be improved without using any separate reinforcing members. Since the flooding passage 42 is formed integrally with the end member 20 and 22, there is no need for a separate member as a flood passage, and the internal structure of the casing 12 can be simplified. The interior of the operation box 88 is isolated from that of the rotary tub 60 by the projected walls 46 and 90. Moreover, the flooding passage 42 has projections 44 for damping the current and preventing splash. In feeding water into the rotary tub 60 and in the washing operation, therefore, waterdrops scattered to the upper portion of the rotary tub 60 can be prevented from entering the operation box 88. The upper and lower ends of the covering member 16 can be fitted individually in their corresponding engaging grooves 56 defined between the projected strips 52 and 54 to retain the covering member 16 temporarily. Thus, assembly efficiency is improved.

Figure 5:
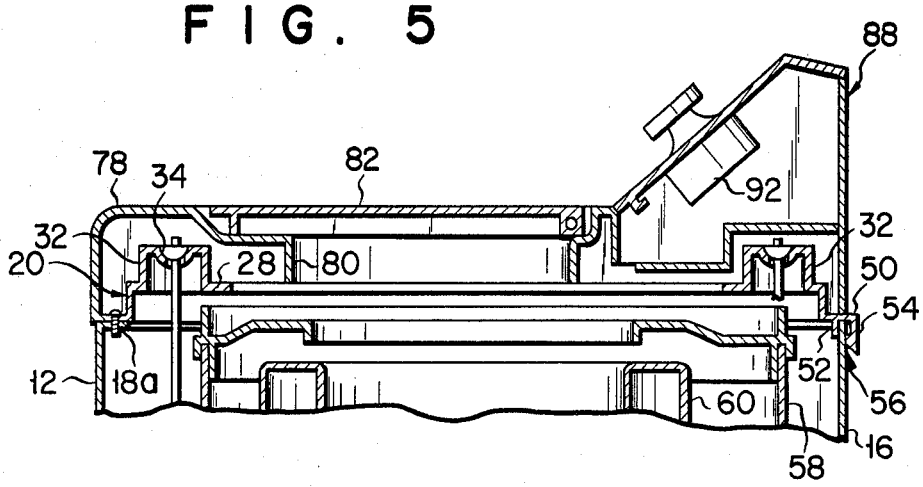
Figure 6:
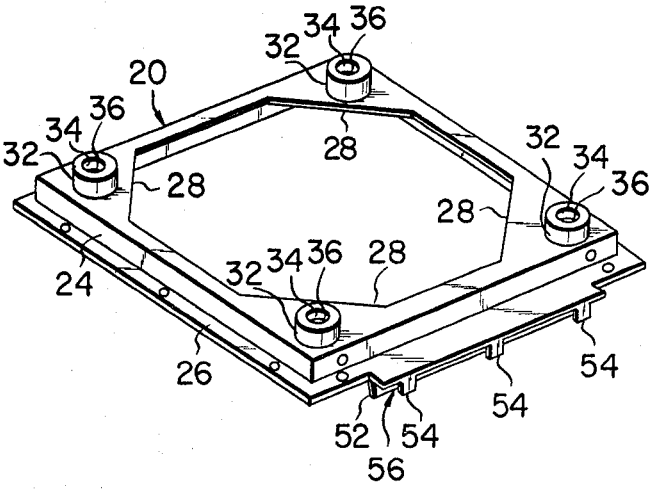

The construction of the end members is not limited to the above embodiment. FIGS. 5 and 6 show a second embodiment of this invention. In this embodiment, the reinforcing plate 30 is removed from each end member, and reinforcing plates 28 are formed individually in the four corners of a frame 24. A protrusion 32 is formed on each reinforcing plate 28. The bottom plate of an operation box 88 is integral with a cover 78. The second embodiment can provide substantially the same effect as the first embodiment. Other portions of the first and second embodiments are similar.

Figure 4:
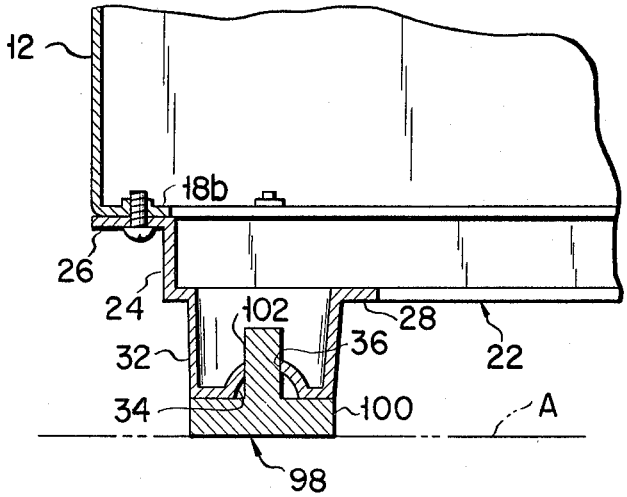
FIG. 4 is a sectional view of the principal part of a washing apparatus according to a modification of the invention.

Referring now to FIG. 4, there will be described those portions of a modification of this invention which are different from their counterparts in the aforementioned embodiments. In this modification, a protective leg 98 formed of elastic material such as rubber is attached to each protrusion 32 of the end member 22. The protective leg 98 has a cylindrical main body 100 and a projected portion 102 protruding therefrom. As the projected portion 102 is inserted in the penetrating hole 34 of the protrusion 32, the protective leg 98 is attached to the protrusion 32. According to this modification, the floor A can be protected against damage by the protective legs 98. The penetrating holes 36 of the protrusions 32 can be used for the attachment of the protective legs 98, as well as for the insertion of suspensions rods 72.

This invention is not limited to the embodiments described above, and various changes and modifications may be effected therein by one skilled in the art without departing from the scope or spirit of the invention. In the above embodiments, the casing is formed from a previously coated steel plate. Alternatively, the casing may be formed from a conventional uncoated steel plate which is to be coated after forming. In this case, the casing according to this invention can be coated more easily than the prior art casing, since it is simple in shape, having no supporting member or legs.

What is claimed is:

1. A washing apparatus comprising:

a casing in the form of a substantially rectangular tube open at both ends;

a water reservoir disposed in the casing;

a rotary tub disposed in the water reservoir;

an agitator disposed in the rotary tub;

driving means attached to the water reservoir and located inside the casing to drive the rotary tub and/or the agitator;

suspending means elastically suspending the water reservoir and the driving means in the casing; and a pair of end members equal in size and shape and attached individually to both ends of the casing, each end member having a substantially rectangular ring-shaped frame attached to the peripheral edge portion at each corresponding end of the casing and protrusions formed individually in the four corners of the frame, the protrusions of one end member constituting support members supporting the suspending means, and the protrusions of the other end member constituting legs of the casing.

2. The washing apparatus according to claim 1, wherein each of said end members is integrally formed from resin by using the same die.

3. The washing apparatus according to claim 2, wherein said casing has flange portions extending inward from the peripheral edges at both ends thereof, and the frames of the end members have their respective flange portions extending outward from the peripheral edges thereof, the flange portions of the frames being attached to their corresponding flange portions of the casing.

4. The washing apparatus according to claim 3, wherein the frame of each said end member has reinforcing plates formed individually in the four corners thereof so that the protrusions are formed individually on the reinforcing plates.

5. The washing apparatus according to claim 4, wherein each said protrusion is in the form of a near cylinder closed at the projected end thereof, and has a concave spherical seat formed in the projected end face thereof and a penetrating hole bored through the spherical seat.

6. The washing apparatus according to claim 5, wherein said suspending means includes four suspension rods, hemispherical sliders attached individually to the one end portions of the suspension rods and slidably supported by the respective spherical seats of the protrusions of the one end member, and elastic members attached individually to the other end portions of the suspension rods and coupled to the water reservoir.

7. The washing apparatus according to claim 5, wherein said casing has an opening for maintenance and inspection formed in one lateral face thereof to extend to both end edges thereof, and a covering member covering the opening.

8. The washing apparatus according to claim 7, wherein each said end member has an overhang portion extending from one side of the flange portion thereof and located in the opening, and a plurality of projected strips protruding from the overhang portion to define an engaging groove, so that the covering member engages the engaging groove to be temporarily retained in the position to block the opening.

9. The washing apparatus according to claim 3, wherein the frame of each said end member has reinforcing plates formed individually in two adjacent corners thereof and another substantially rectangular reinforcing plate stretching over the remaining two corners thereof, so that the protrusions are formed individually on the two reinforcing plates and both end portions of the third reinforcing plate.

10. The washing apparatus according to claim 9, wherein each said end member has a bank portion formed on the third reinforcing plate to define a flooding passage to guide supplied water into the rotary tub.

11. The washing apparatus according to claim 9, wherein each said protrusion is in the form of a near cylinder closed at the projected end thereof, and has a concave spherical seat formed in the projected end face thereof and a penetrating hole bored through the spherical seat.

12. The washing apparatus according to claim 11, wherein said suspending means includes four suspension rods, hemispherical sliders attached individually to the one end portions of the suspension rods and slidably supported by the respective spherical seats of the protrusions of the one end member, and elastic members attached individually to the other end portions of the suspension rods and coupled to the water reservoir.

13. The washing apparatus according to claim 11, wherein said casing has an opening for maintenance and inspection formed in one lateral face thereof to extend to both end edges thereof, and a covering member covering the opening.

14. The washing apparatus according to claim 13, wherein each said end member has an overhang portion extending from one side of the flange portion thereof and located in the opening, and a plurality of projected strips protruding from the overhang portion to define an engaging groove, so that the covering member engages the engaging groove to be temporarily retained in the position to cover the opening.

15. The washing apparatus according to claim 1, which further comprises protective legs formed of elastic material attached individually to the protrusions of the other end member, each the protective leg having a cylindrical main body and a projected portion protruding therefrom and passed through the penetrating hole of its corresponding projection.

16. The washing apparatus according to claim 1, which further comprises a cover attached to the one end member to cover the same, the cover having an opening through which washing is put into and taken out of the rotary tub, and an operation box.

17. The washing apparatus according to claim 1, wherein said casing is formed by bending a steel face plate.

* * * * *